US006474783B1

(12) United States Patent
Pilossof et al.

(10) Patent No.: US 6,474,783 B1
(45) Date of Patent: Nov. 5, 2002

(54) INK-JET PRINTING APPARATUS AND METHOD USING LASER INITIATED ACOUSTIC WAVES

(75) Inventors: Nissim Pilossof, Rehovot; Josef Ronen; Aharon Korem, both of Herzlia, all of (IL)

(73) Assignee: Aprion Digital Ltd., Netanya (IL)

( * ) Notice: Subject to any disclaimer, the term of this patent is extended or adjusted under 35 U.S.C. 154(b) by 0 days.

(21) Appl. No.: 09/457,477

(22) Filed: Dec. 9, 1999

(30) Foreign Application Priority Data

Dec. 9, 1998 (IL) ..... 127484

(51) Int. Cl.[7] ..... B41J 2/14
(52) U.S. Cl. ..... 347/51
(58) Field of Search ..... 347/51, 52, 54, 347/55, 66, 46–47, 20; 216/24, 26, 27; 438/21

(56) References Cited

U.S. PATENT DOCUMENTS

| | | | | |
|---|---|---|---|---|
| 3,798,365 A | | 3/1974 | Browning et al. | 358/296 |
| 4,283,731 A | * | 8/1981 | Bok et al. | 347/4 |
| 4,312,009 A | | 1/1982 | Lange | |
| 4,463,359 A | | 7/1984 | Ayata et al. | 347/56 |
| 4,531,138 A | | 7/1985 | Endo et al. | 347/51 |
| 4,607,267 A | | 8/1986 | Yamamuro | 347/51 |
| 4,703,330 A | | 10/1987 | Culpepper | 347/43 |
| 4,723,129 A | | 2/1988 | Endo et al. | 347/56 |
| 4,727,379 A | * | 2/1988 | Sourlis et al. | 347/47 |
| 4,751,534 A | | 6/1988 | Elrod et al. | 347/46 |
| 4,849,774 A | | 7/1989 | Endo et al. | 347/56 |
| 4,959,674 A | | 9/1990 | Khri-Yakub et al. | 347/46 |
| 5,021,808 A | | 6/1991 | Kohyama | |
| 5,087,930 A | | 2/1992 | Roy et al. | 347/85 |
| 5,121,141 A | | 6/1992 | Hadimoglu et al. | 347/46 |
| 5,339,101 A | | 8/1994 | Rawson et al. | 347/46 |
| 5,446,485 A | | 8/1995 | Usui et al. | 347/72 |
| 5,594,480 A | * | 1/1997 | Sato et al. | 347/51 |
| 5,594,556 A | | 1/1997 | Vronsky et al. | 358/482 |
| 5,677,718 A | | 10/1997 | Crawford et al. | 347/92 |
| 5,722,479 A | | 3/1998 | Oeftering | |
| 5,808,636 A | * | 9/1998 | Stearns | 347/46 |
| 5,877,800 A | * | 3/1999 | Robinson et al. | 347/255 |
| 5,880,759 A | * | 3/1999 | Silverbrook | 347/48 |
| 5,992,963 A | * | 11/1999 | Miyake et al. | 347/18 |
| 6,136,210 A | * | 10/2000 | Biegelsen et al. | 216/26 |
| 6,306,671 B1 | * | 10/2001 | Silverbrook | 216/27 |

FOREIGN PATENT DOCUMENTS

| | | | |
|---|---|---|---|
| EP | 0 051 468 A2 | 5/1982 | |
| EP | 0 683 048 A2 | 11/1995 | |
| EP | 0816083 | 1/1998 | B41J/2/05 |
| EP | 082238 | 2/1998 | B41J/2/015 |
| EP | 0858902 | 8/1998 | B41J/2/44 |
| WO | WO 97/29913 A1 | 8/1997 | |

OTHER PUBLICATIONS

Gusev, V.E and Karabutov, A.A. *Laser Optoacoustics,* American Institute of Physics, pp 1,2,39 1993.
David R..Lide, Ph.D. (ed) *CRC Handbook of Chemistry and Physics,* CRC Press. p 14–35 1991.

* cited by examiner

*Primary Examiner*—John Barlow
*Assistant Examiner*—K. Feggins
(74) *Attorney, Agent, or Firm*—Eitan, Pearl, Latzer & Cohen-Zedek

(57) ABSTRACT

A printing device including a laser for generating at least one laser beam, a controller, a print head having a plurality of orifices, and an ink supply for supplying ink to the print head. The controller modulates the at least one modulated laser beam according to image data to be printed. The at least one modulated laser beam selectively generates a directional acoustic wave within the print head, thereby inducing an ink droplet to exit a selected one of the orifices onto a printing substrate. A print head including a single buffer chamber, a body, and a single ink chamber. The buffer chamber stores a buffer liquid therein with the body forming one wall of that chamber. The ink chamber shares the body as a wall. The ink chamber stores ink therein and has a plurality of orifices on a wall opposite to the body.

32 Claims, 11 Drawing Sheets

INK-JET PRINTING APPARATUS AND METHOD USING LASER INITIATED ACOUSTIC WAVES

FIELD OF THE INVENTION

The present invention relates generally to an ink jet printing method and apparatus. More specifically it is related to a drop-on-demand ink jet printing method and apparatus in which the droplet ejection is initiated by a light pulse.

BACKGROUND OF THE INVENTION

There are two general types of drop-on-demand ink jet printing engines: piezoelectric and thermal (bubble-jet).

The first type is based on the expansion and contraction of a piezoelectric crystal due to an electrical field pulse applied along a certain crystal axis. By means of a lever and membrane this mechanical movement is conveyed to the ink in the ink chamber, thus rapidly raising the pressure in the chamber, causing an ink droplet to eject from the chamber nozzle orifice.

The second type of printing engine consists of an ink chamber with a nozzle and a heating element in thermal contact with the ink in the ink chamber. An electrical current pulse applied to the heating element results in the rapid rise of the ink temperature in the immediate vicinity of the heating element, causing rapid evaporation and bubble generation. The bubble expansion and contraction results in the ejection of an ink droplet from the nozzle orifice.

The following problems are common to both the piezoelectric and thermal ink jet technologies:

a) The ink droplet ejection rate is relatively slow. The rate at which a nozzle can repeatedly eject ink droplets is limited by the piezo-crystal resonance or by the bubble generation—contraction time.

b) The electronic drivers and their wiring make the systems very complicated.

c) It is difficult to build a dense multi-nozzle structure, since the physical dimensions of the actuators limit the direct nozzle pitch. It is extremely difficult to miniaturize a piezo-crystal in order to raise the resonance frequency and at the same time keep the amplitude of the vibrations sufficiently high. Similarly, the more electrical energy needed in the initiating pulse of a bubble-jet engine, the larger the dimensions of the heating element must be.

This last problem is shown in FIG. 1, to which reference is now made, which is an illustration of a prior art nozzle structure. A configuration of nozzles 2, each supplied with ink via an opening 3, and each having an actuator 4 within, is arranged so as to minimize the distance $D_1$, known as the "direct nozzle pitch", between the centers of the actuators 4. An actuator 4 may be, for example, a piezo-crystal or a heating resistor. Each nozzle 2 is tapered so that its orifice 6 is smaller than its opening 3. The orifices form an orifice array 8. The distance $D_2$ between the orifices 8 is known as the "orifice pitch". The current state of the art technology allows placing the actuators at a minimum distance of 200–250 micrometers from one another. The structure forming the orifice array 8 already has a much smaller pitch. For example a print head with a linear array of 1,000 nozzles will have a total length of approximately 200 millimeters, while the length of the orifice array will be only 30 to 50 millimeters.

The following additional problems are specific to bubble-jets:

a) The types of ink that can be used in a bubble-jet engine are limited to those inks whose desired chemical and physical properties do not change when the ink is heated.

b) There is a passivation layer on the heating element electrodes, which protects them from reacting with the ink. The violent process of bubble generation progressively degrades this passivation layer, thereby shortening its lifetime.

c) Special measures for cooling the ink are required.

There is yet another ink jet printing technology, which employs the power of an acoustic wave as an immediate agent for ink droplet ejection. By means of a piezo-crystal or other acoustic generator, a pulse of acoustic waves is generated. These waves, which propagate in the ink volume, are focussed by means of acoustic lenses on the free ink surface or on the nozzle's orifice. Due to the big difference in the acoustic impedance of the ink and the air, an ink droplet is ejected. These types of printing heads have most of the drawbacks of the piezoelectric ink jet. In addition, the ink droplet ejection is sensitive to the wave focussing. Furthermore, in the case of a free ink surface, parasitic surface waves can cause unwanted ink droplet ejection, or can interfere with desired ink droplet ejection.

It can be seen that the conventional ink jet printing methods have intrinsic drawbacks and can be used only in a limited number of applications. Efforts to improve on conventional ink jet technologies have been directed at achieving denser multi-nozzle structures, higher speed operation, ink type independence and simpler manufacturing.

There have been a number of attempts to solve the problems described above. U.S. Pat. Nos. 3,798,365, 4,463,359, 4,531,138, 4,607,267, 4,723,129 and 4,849,774 and European Patent Applications Nos. EP 0 823 328 A1 and EP 0 858 902 A1 describe variations on the existing ink jet technology. In all of these variations, significant problems remain.

European patent application No. EP 0 816 083 A2 discloses a double chamber bubble-jet engine. The ink chamber and the chamber with the working liquid are separated by a membrane which is thermally conductive and thermally expansive. The bubble is generated in the working chamber by means of an electrically controlled heater. The membrane conveys the pulse pressure generated in the working chamber to the ink chamber, and as a result, a droplet of ink is ejected out of the orifice. Thermal conductivity of the membrane is necessary in order to provide efficient cooling of the working liquid. This method inherits all the problems of the conventional bubble-jet method except for ink type limitation. The requirement for thermal conductivity of the membrane limits the materials and technologies for its production.

In a number of patents such as U.S. Pat. Nos. 4,703,330, 4,751,534, 5,339,101, 4,959,674, 5,121,141, 5,446,485, 5,677,718 and 5,087,930, different types of acoustic ink jet printers and improvements in acoustic wave focussing systems are disclosed. In all these engines the above-mentioned problem with complicated wiring is still present. The physical size and large number of individual acoustic sources limit the density of a multi-nozzle head.

SUMMARY OF THE INVENTION

An object of the present invention is to provide an ink jet printing apparatus and method free of the above-mentioned problems of conventional ink jets. The present invention is a practical method for producing high-speed, dense multi-nozzle, simple construction printing heads.

There is provided in accordance with a preferred embodiment of the present invention a print head including a single buffer chamber, a body, and a single ink chamber. The single buffer chamber stores a buffer liquid therein. The body forms one wall of the buffer chamber. The single ink chamber shares the body as a wall. The single ink chamber stores ink therein and has a plurality of orifices on a wall opposite to the body.

There is provided in accordance with another preferred embodiment of the present invention a print head including a single ink chamber, a single buffer chamber, and a body between the ink chamber and the buffer chamber. The ink chamber stores ink therein and has a plurality of orifices. A droplet of the ink exits through a selected one of the orifices in the presence of a directional acoustic wave in the vicinity of the selected orifice. The buffer chamber stores a buffer liquid therein within which the acoustic wave is generated. The body provides acoustic coupling between the ink and the buffer liquid.

Moreover, in accordance with a preferred embodiment of the present invention, the plurality of orifices is arranged in a linear array or a two-dimensional array.

Furthermore, in accordance with a preferred embodiment of the present invention, the body is formed of a material which minimizes attenuation of the acoustic wave.

Additionally, in accordance with a preferred embodiment of the present invention the acoustic wave is generated by absorption of laser light in the buffer liquid.

In accordance with a preferred embodiment of the present invention, a wall of the buffer chamber opposite to the body is an optical element substantially transparent for the laser light.

Moreover, in accordance with a preferred embodiment of the present invention, the optical element is a flat optical window or a microlens array which improves focussing of the laser light into the buffer liquid.

There is provided in accordance with a further preferred embodiment of the present invention a printing device including a laser for generating at least one laser beam, a controller, a print head having a plurality of orifices, and an ink supply for supplying ink to the print head. The controller modulates the at least one modulated laser beam according to image data to be printed. The at least one modulated laser beam selectively generates a directional acoustic wave within the print head, thereby inducing an ink droplet to exit a selected one of the orifices onto a printing substrate.

Moreover, in accordance with a preferred embodiment of the present invention, the printing device is a printing press or an ink-jet printer.

Furthermore, in accordance with a preferred embodiment of the present invention, the laser is a laser diode.

Additionally, in accordance with a preferred embodiment of the present invention, the print head is as described above.

Moreover, in accordance with a preferred embodiment of the present invention, the printing device additionally comprises a scanner for moving the modulated laser beam in a scanning direction such that the modulated laser beam is focussed in the vicinity of the selected orifice.

Furthermore, in accordance with a preferred embodiment of the present invention, the buffer liquid flows in a direction perpendicular to the scanning direction.

Moreover, in accordance with a preferred embodiment of the present invention, the buffer liquid is cooled.

There is provided in accordance with a further preferred embodiment of the present invention a printing method for printing ink upon a printing substrate. The method includes the steps of generating a directional acoustic wave within a print head, propagating the acoustic wave toward a selected orifice of the print head, and inducing a droplet of the ink to exit the selected orifice onto the printing substrate. The directional acoustic wave is generated upon absorption of a laser beam within the print head.

Moreover, in accordance with a preferred embodiment of the present invention, the step of generating occurs within a buffer liquid contained in the print head.

Furthermore, in accordance with a preferred embodiment of the present invention, the step of propagating occurs from the buffer liquid through a body into the ink.

BRIEF DESCRIPTION OF THE DRAWINGS

The present invention will be understood and appreciated more fully from the following detailed description taken in conjunction with the appended drawings in which.

In all figures the same numerals are allocated to the same features.

DETAILED DESCRIPTION OF THE PRESENT INVENTION

The ink jet printing apparatus of the present invention provides a printing device which utilizes a high-density, multi-orifice print head for high-speed printing. The print head structure is relatively simple even for a two-dimensional orifice configuration, since a single, continuous ink chamber is used for all of the orifices. This printing device can be realized as any type of printing device, such as a digital printing press or an ink-jet printer. Now with reference to the attached drawings a detailed description of the preferred embodiments will be made.

Figure 1:
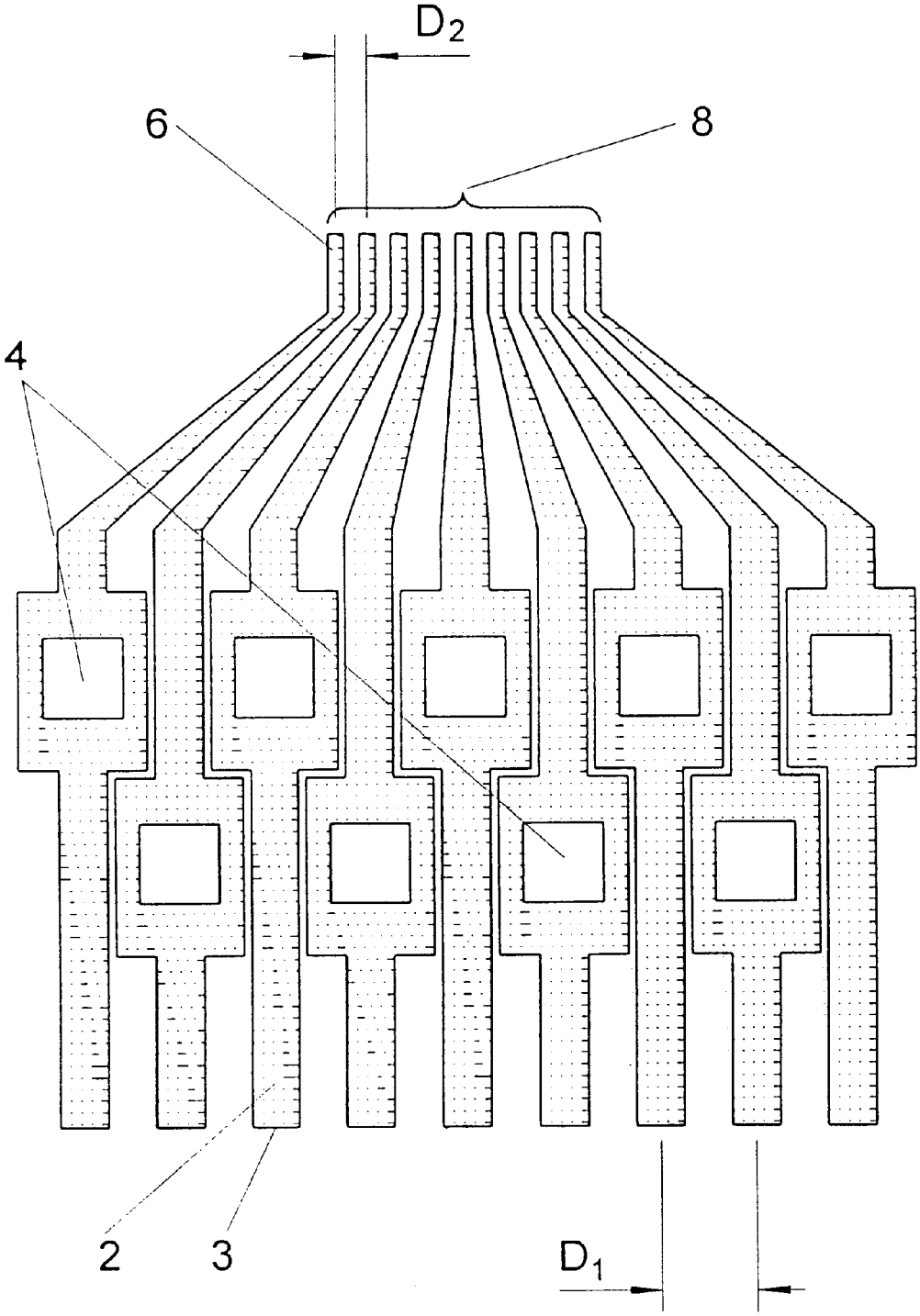
Figure 1 (PRIOR ART)
FIG. 1 is a schematic illustration of a prior art nozzle structure.
Figure 2A:
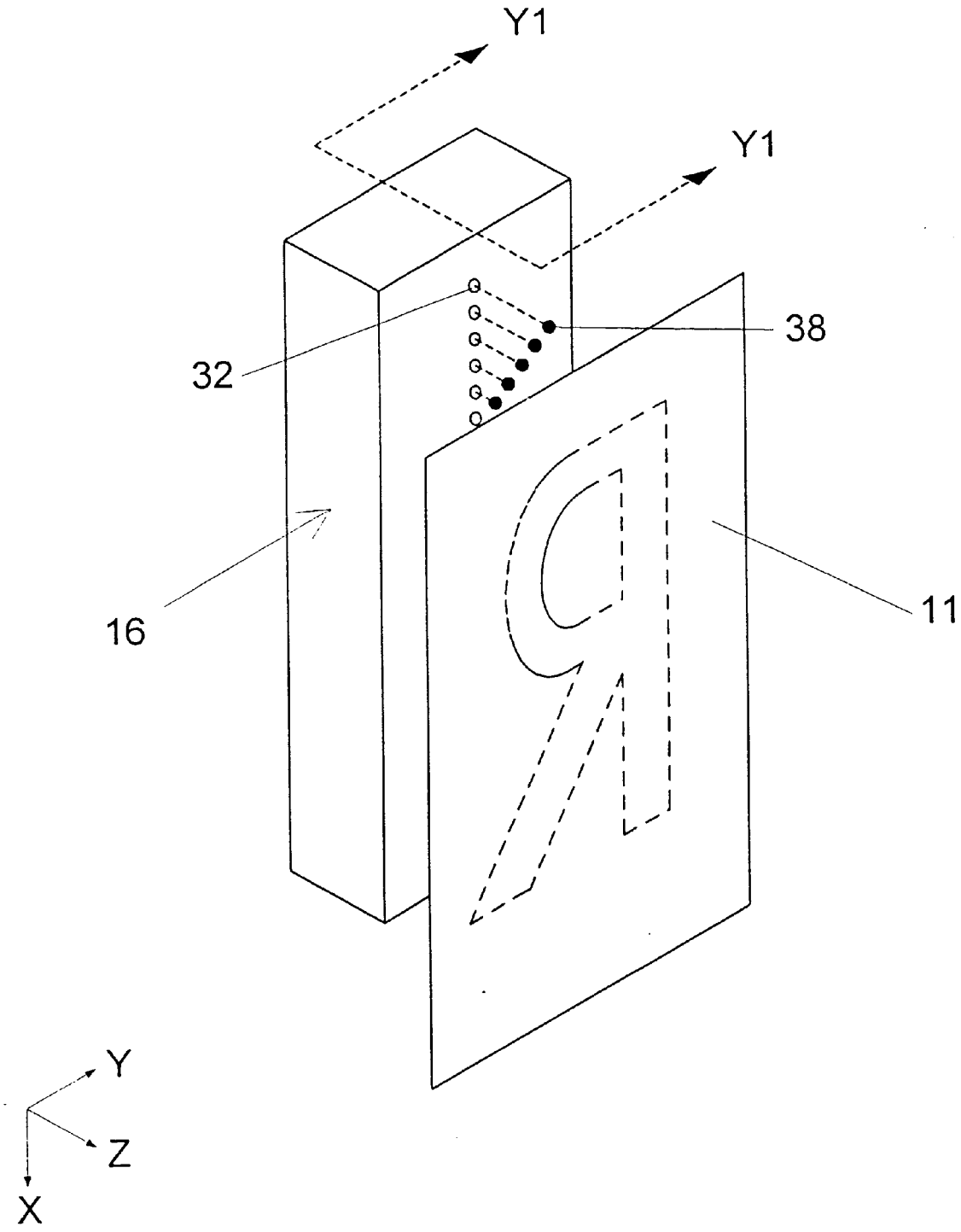
FIG. 2A is a schematic isometric illustration of a linear array print head.

FIG. 2A, to which reference is now made, is provided for orientation purposes. FIG. 2A is a schematic isometric view of a print head 16, shown with reference to X-Y-Z coordinates. The print head 16 has a linear array of nozzle orifices 32. Ink droplets 38 ejected from the nozzle orifices 32 hit a printing substrate 11, for example a paper sheet (shown from the back), to form the printed letter "R".

Figure 2B:
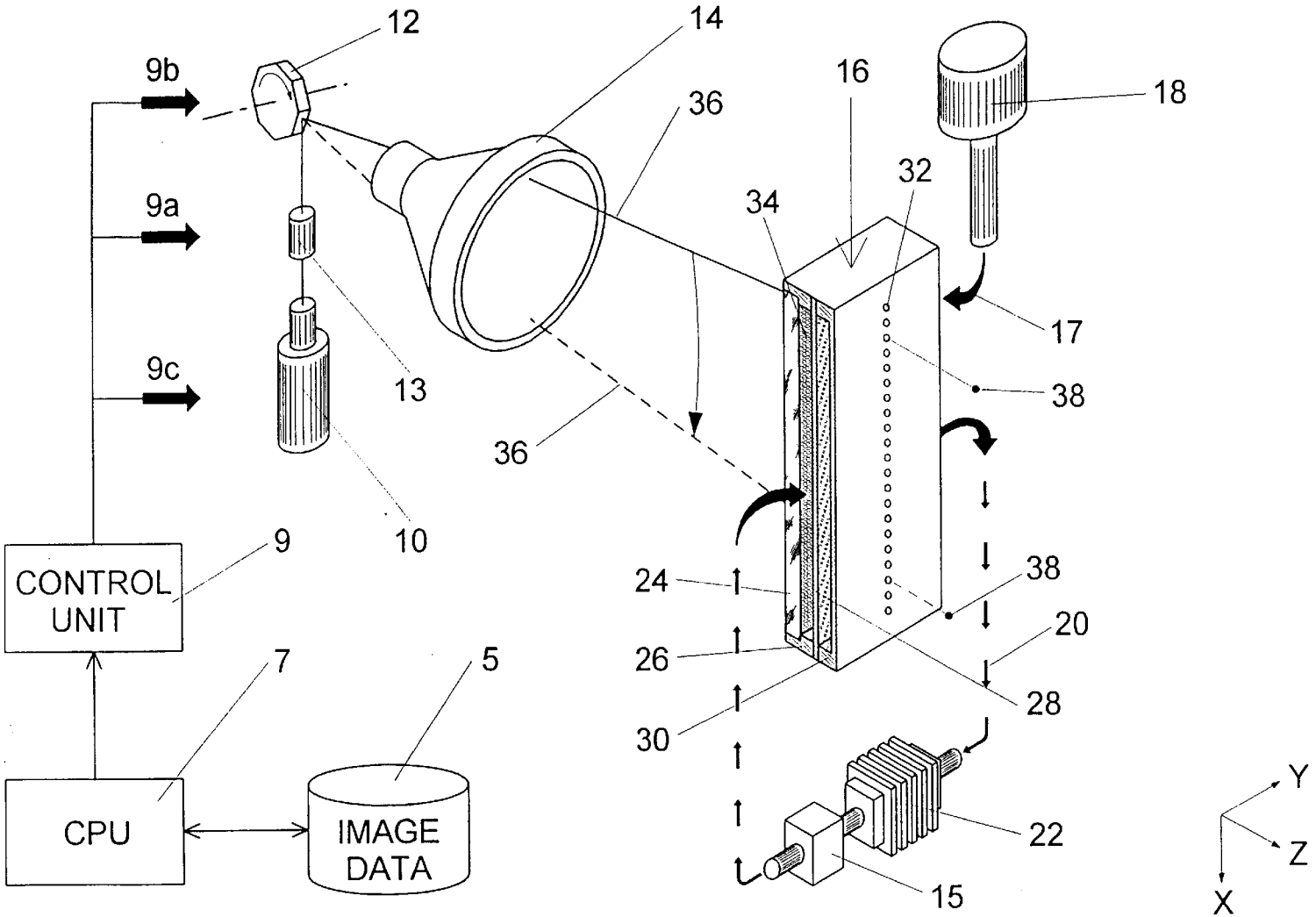
FIG. 2B is a schematic isometric illustration of a print engine based on the print head of FIG. 2A, including its laser actuation device.

Reference is now made to FIG. 2B, which is a schematic illustration of a print engine based on the print head 16 of FIG. 2A, including its laser actuation device. The print head 16 is cut along the side along the line Y1—Y1 (FIG. 2A). The print engine comprises a single-beam laser source 10, a light modulator 13, a scanning system 12, a telecentric lens 14, the print head 16, a closed loop, indicated by arrows 20, through which buffer liquid is pumped by a pump 15, and a passive or active cooling element 22, which is part of the closed loop.

The laser source 10 could be for example a YAG laser such as the Compass-4000 from the Coherent Laser Group of Santa Clara, Calif., USA, or a laser diode such as the SDL-2380 from SDL Inc. of San Jose, Calif., USA. In the case of a YAG laser source, the light modulator 13 could be an acousto-optic modulator, for example of the TEM-0-0 type from the Brimrose Corporation of America, of Baltimore, Md., USA. In the case of a laser diode source, the beam is modulated not by an optical modulator, but by directly modulating the laser diode current, as shown by arrow 9*c*. The laser beam modulator 13 is controlled (indicated by the arrow 9*a*), as known in the art, by a control unit 9, which is driven by a CPU 7, according to an image data 5 to be printed on the substrate (not shown in FIG. 2B).

The print head 16 comprises a window 24, a buffer liquid chamber 26, an intermediate body 28, and an ink chamber 30 with a linear array of nozzle orifices 32. The window 24 is made of material which is substantially transparent to laser light, and in the preferred embodiment is a flat optical window. The intermediate body 28 is chosen so that its acoustic impedance matches that of the buffer liquid 34 and the ink 17, and so that it is composed of a material with as small as possible bulk acoustic attenuation. The window 24 and the intermediate body 28 form the front and the back of the buffer liquid chamber 26. The intermediate body 28 separates the buffer liquid chamber 26 from the ink chamber 30. The ink chamber 30 is supplied with printing ink 17 by the ink supply system 18. A constant supply of cooled buffer liquid 34 is pumped into the buffer liquid chamber 26. The buffer liquid 34 is preferably characterized by very high absorption for laser light.

The modulated light from the laser 10 is made to scan by means of the scanning system 12. An example of a scanning system that is well known in the art is a mirror polygon that rotates quickly. The light from the scanning system 12 is focussed by the telecentric lens 14, such as model 59 LLS056 from Melles Griot of Rochester, N.Y., USA, into a scanned laser beam 36, with the focus in the buffer liquid chamber 26. The laser beam 36 is directed along the Z-axis toward the print head 16, and moves in the X-direction when scanned. The laser light pulse passes through the window 24 and is absorbed by the buffer liquid 34 in the buffer liquid chamber 26. The temperature and pressure of the buffer liquid 34 in the vicinity of the focus of the light pulse rise quickly, creating an acoustic wave. The acoustic wave propagates in the buffer liquid 34, crosses the intermediate body 28, and enters the ink chamber 30. When the acoustic wave reaches the ink—air interface at the nozzle orifice 32, a droplet 38 of ink 17 is ejected from the print head 16 in the Z-direction, and hits the printing substrate 11 (FIG. 2A). The heated buffer liquid 34 is constantly replaced by cooled buffer liquid 34, so that the heat generated by the light absorption is carried away from the ink chamber 26 and is absorbed by the cooling element 22.

As the laser beam 36 scans the print head 16 in the scanning direction X, a droplet 38 of ink 17 is ejected from each ink orifice 32 in turn. The scanning system 12 operates continuously, but the single beam of the laser source 10 is turned on and off, thereby determining from which orifices 32 an ink droplet 38 will be ejected. This operation produces the desired image formed by droplets 38 on the printing substrate 11 (FIG. 2A).

The scanning of the laser beam 36 in the X-direction, and the timed energy pulses, which will be delivered when needed coordinated with the position of the nozzle orifices 32, are controlled by the control unit 9 via arrow 9B, as described in U.S. Pat. No. 5,594,556 of the present Assignee.

Figure 3:
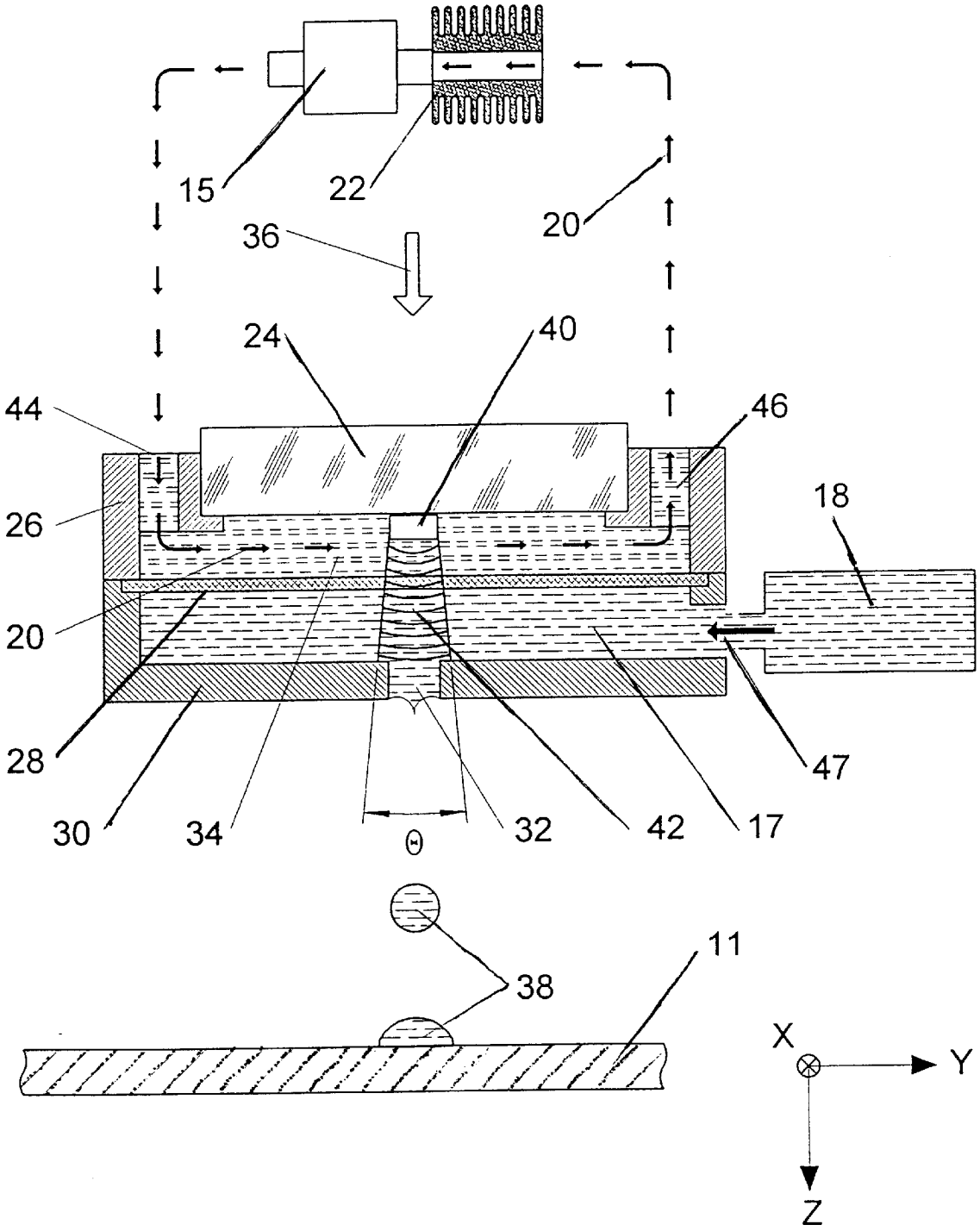
FIG. 3 is a schematic illustration indicating the working principle of the print head of FIGS. 2A and 2B.

Reference is now made to FIG. 3, which is a schematic illustration indicating the working principle of the print head 16 of FIGS. 2A and 2B. A pulse of up to 1 microsecond of laser light energy propagating along the Z-axis of the laser beam 36 is focussed by the telecentric lens 14 (FIG. 2B) into the buffer liquid chamber 26. The laser light is concentrated within a small volume 40 of the buffer liquid 34. Due to the high absorption of the laser pulse energy in a very small volume, the temperature and pressure in volume 40 rise rapidly, and, as a result, a pulse of acoustic waves is generated. The small absorbing volume 40 of the buffer liquid acts as a thermo-optical source of acoustic waves. The acoustic wave is radiated within the limits of a cone 42 with a small apex angle Θ. Thus, in a preferred embodiment, the acoustic wave is concentrated at the axis of the laser beam 36. In accordance with a preferred embodiment of the present invention, this allows the acoustic energy to be delivered to the orifice without using an acoustic lens. Furthermore, the interference of acoustic waves from one light pulse with acoustic waves from a light pulse at a neighboring orifice is negligible. This allows the construction of simple print heads having a dense multi-nozzle structure, without a dedicated buffer chamber, ink chamber and ink supply path for each nozzle. The minimum nozzle pitch will depend on the chosen thickness of the buffer liquid chamber and of the ink chamber, and will depend on the apex angle of the acoustic wave's cone, and it can be made, for example, 30 micrometers or smaller. Returning to the above-mentioned example, a print head of the present invention having a linear array of 1,000 orifices will have a total length of approximately 30 millimeters, compared to the 200 millimeter length of a conventional ink-jet technology print head.

As was noted above, the generated pulse of acoustic energy propagates in the buffer liquid 34 within cone 42, and reaches the thin intermediate body 28. The intermediate body 28 serves as a pressure insulator between the buffer chamber 26 and the ink chamber 30. The acoustic wave is generated during the first several hundred nanoseconds of the light absorption in the buffer liquid 34, while the bubble is still in nuclei state. During the next several microseconds, the bubble expands in volume, and the intermediate body 28 prevents the pressure generated by this volume expansion from being conveyed to the ink chamber 30. Due to the acoustic impedance matching of the buffer liquid 34, the intermediate body 28 and the ink 17, the acoustic wave passes through the intermediate body 28 without significant disturbance.

After passing the intermediate body 28, the acoustic wave propagates through the ink 17 and reaches the ink—air interface at the ink chamber orifice 32. At the ink—air interface there is a strong mismatch of the acoustic impedance, and, as result, the energy of the acoustic wave is transformed into kinetic energy of part of the ink 17 which is near the surface, resulting in the ejection of the ink droplet 38.

By pumping means 15 the buffer liquid 34 flows in a closed-loop constant flow, indicated by arrows 20. The direction Y of the flow within the buffer chamber is perpendicular to the laser beam direction Z, and perpendicular to the scanning direction X. This ensures that cooled buffer liquid 34 is always provided to wherever the focus of the laser is. The buffer chamber 26 is supplied with a system of inlet 44 and outlet 46 openings through which the buffer liquid 34 enters and exits the chamber respectively.

The ink 17 is supplied to the ink chamber 30 via a system of inlet 47 openings.

It is appreciated that the above-described process of droplet ejection is substantially independent of the color or chemical composition of the ink. All water-based inks have substantially the same acoustic impedance. Since the laser pulse is absorbed in the buffer liquid, the absorption of laser light in the ink is unimportant. Furthermore, since the ink is not heated as part of the above- described process, chemical and mechanical changes in the ink do not occur.

Figure 4:
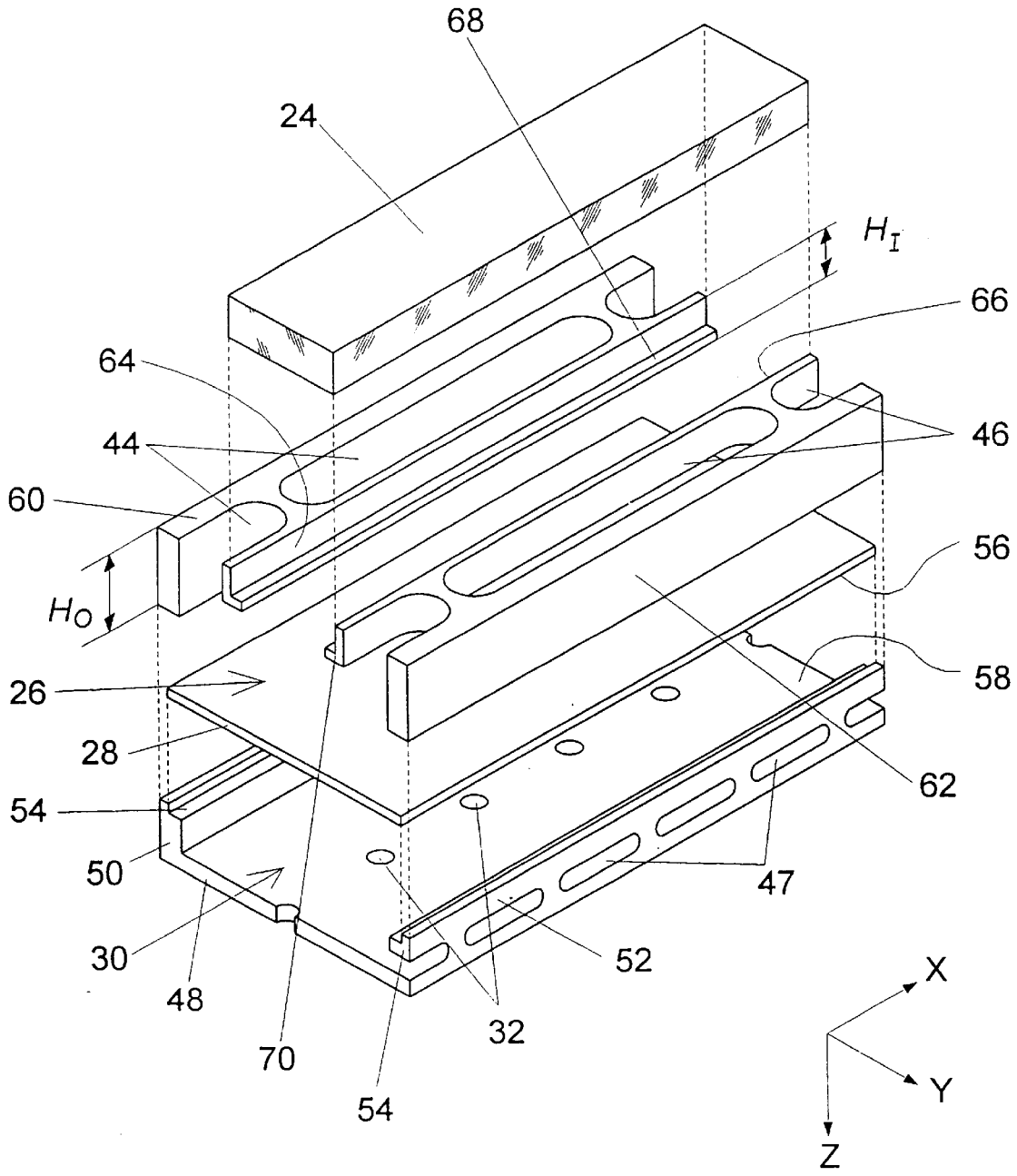
FIG. 4 is an exploded isometric view of the linear array print head of FIGS. 2A and 2B.

Reference is now made to FIG. 4, which presents an exploded isometric view of the linear array print head of FIGS. 2A and 2B. The ink chamber 30 is formed as a flat trough 48, on the bottom which is a linear array of orifices. One side 50 of the trough 48 is solid. The other side 52 of the trough 48 has inlets 47 to allow a supply of ink 17 to enter. Both sides 50, 52 of the trough 48 are indented on the inside, to form a ledge 54 on which the intermediate body 28 is placed. The ink 17 is then located between the lower side 56 of the intermediate body 28 and the upper side 58 of the trough 48.

Above the intermediate body 28 are two side-pieces 60, 62, that, together with the intermediate body 28 and the window 24, form the buffer liquid chamber 26. Side-piece 60 has inlets 44 to allow the in-flow of the cooled buffer liquid 34. Side pieces 62 has outlets 46 to allow the out-flow of the buffer liquid 34. The inner height $H_I$ of the side-pieces 60, 62 is shorter than the outer height $H_O$ of the side-pieces 60, 62, and the inner sides 64, 66 of the side-pieces 60, 62, respectively, have ledges 68, 70 jutting out. The window 24 is placed on the ledges 68, 70 of the side-pieces 60, 62, such that the window 24 does not obstruct the inlets 44 and outlets 46, and flow of the buffer liquid 34 is enabled.

Figure 5A:
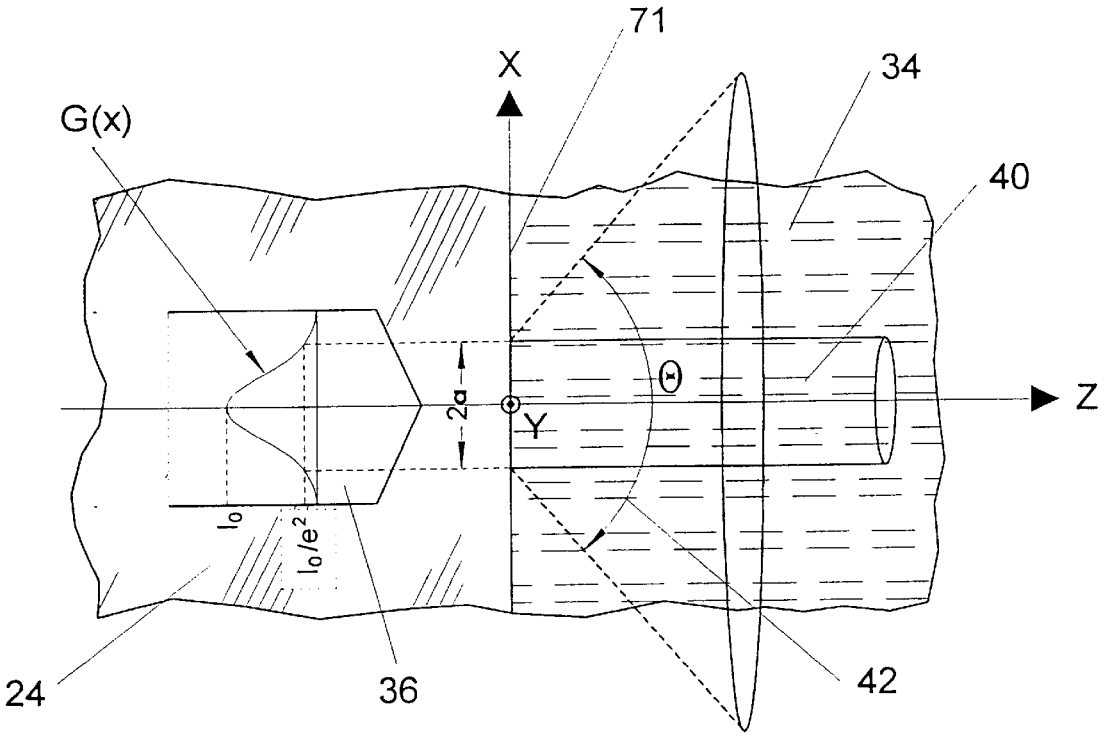
FIGS. 5A and 5B illustrate the process of laser light absorption in the buffer liquid, useful in understanding the operation of the print head of FIGS. 2A and 2B.
Figure 5B:
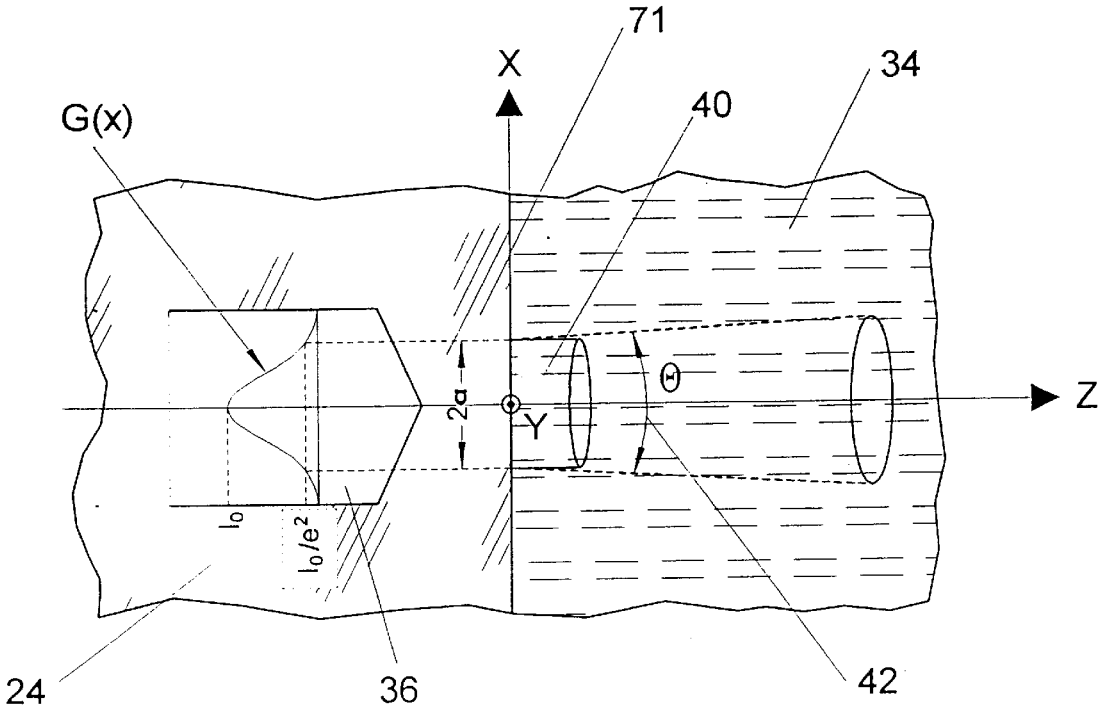
Figure 6:
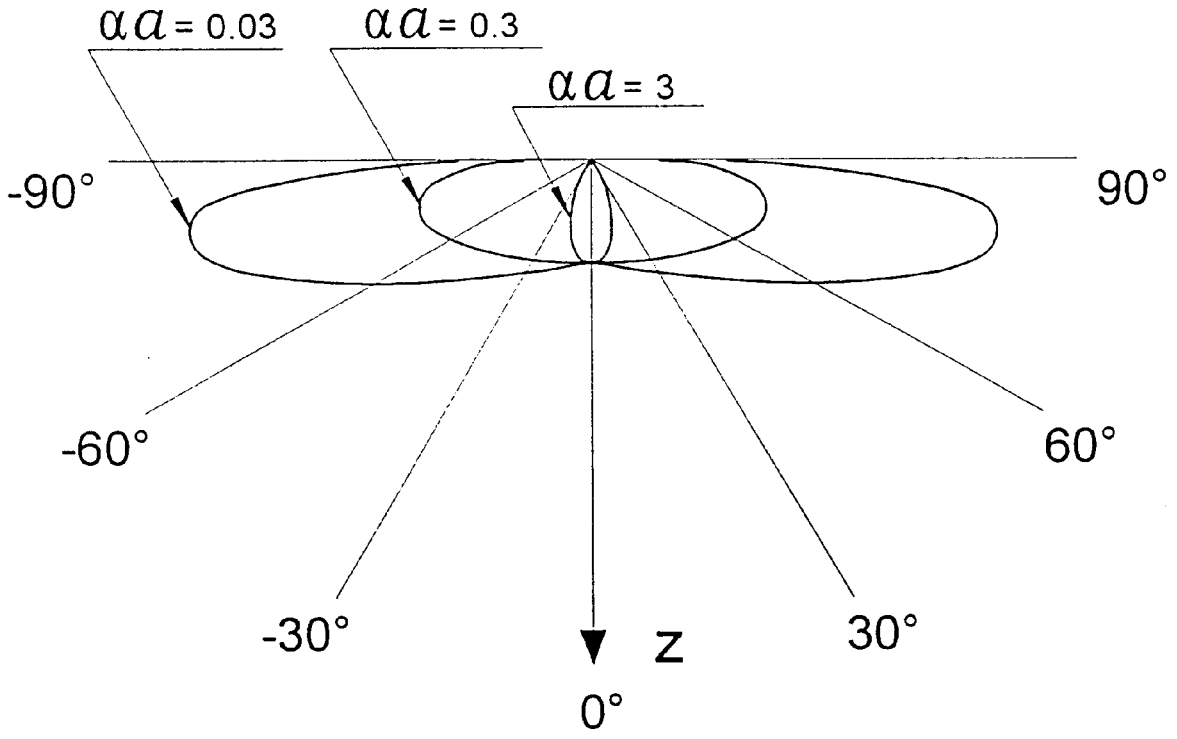
FIG. 6 illustrates the directional pattern of opto-acoustical signal radiation for different source geometries, useful in understanding the operation of the print head of FIGS. 2A and 2B.

Reference is now made to FIGS. 5A and 5B, which illustrate the processes of the laser light absorption in the buffer liquid 34 and the generation of an opto-acoustical wave. A laser beam 36 propagates along the Z-axis through the glass 24 and enters the absorbing buffer liquid 34. The light intensity along the Z-axis in the buffer liquid 34 is described by $I(z,r,t)=I_0f(t)G(r)e^{-}$, where $I_0$ denotes the light intensity on the interface 71 of the window 24 and the buffer liquid 34 at t=0, r=0, f (t) is a dimensionless function describing the time dependence of the light intensity, G(r) is the distribution of light intensity in the beam cross section (assuming radial symmetry), and $\alpha$ (with dimensions of 1/meter) is the absorption coefficient of the buffer liquid 34. For laser beams, the distribution function G(r) is Gaussian: $G(r)=\exp(-2r^2/a^2)$. The parameter a, called the Gaussian beam radius, is the radius at which the intensity on the Z-axis has decreased to $(1/e^2)I_0$. When $\alpha a<<1$ (FIG. 5A) the absorption is "weak" and the absorbing volume 40 takes the shape of a long cylinder along the Z-axis. When $\alpha a>>1$ (FIG. 5B) the absorption is "strong" and the absorbing volume 40 takes the shape of a disk adjacent to the interface 71 of the window 24 and the buffer liquid 34. It can be shown that the directional pattern of the opto-acoustical wave radiated from the absorbing volume 40 strongly depends on the value $\alpha a$. This is discussed in V. E. Gusev, A. A. Karabutov, *Laser Optoacoustics*, American Institute of Physics, 1993, pp. 1, 2, 39 and further, which is incorporated herein by reference. The apex angle $\Theta$ of the cone 42 within which the acoustic wave is radiated is determined by $\tan(\Theta))<2(\alpha a)^{-1}$. Directional patterns for different values of $\alpha a$ are illustrated in FIG. 6. It can be seen that, in case of strong absorption (i.e. $\alpha a>>1$), the apex angle $\Theta$ is small and the acoustic field is concentrated around the axis of the laser beam 36.

One of the criteria for selecting the material of the intermediate body 28 is that its acoustic impedance be substantially similar to that of the buffer liquid 34 and the ink 17. An example of how to achieve good acoustic impedance matching and good absorption of the laser light will now be given. Typical examples of buffer liquids with very high absorption (i.e. $\alpha a>>1$) for the near-infrared spectrum are highly concentrated alcoholic or ketonic solutions of the infrared absorbers PRO-JET 830NP and S175139/2 from Zeneca Specialist Colours of Manchester, England.

The value for the apex angle $\Theta$ of the cone 42, when using 1:1 solution of PRO-JET 830P as a buffer liquid, is determined as follows: A layer of 1 micrometer thickness of this solution absorbs 85% of the laser energy at 830 nm. This leads to $\alpha\cong 2*10^6 m^{-1}$. If the laser beam is focussed into a spot of 20 micrometers, then $\alpha\cong 10^{-5}m$, $\alpha a\cong 20$, and $\Theta<6°$.

Acoustic impedance matching can be done as follows. Water-based inks have an acoustic impedance $Z_{INK}$ of approximately $1.5*10^8$ g/(m$^2$.s), and an ethanol amide based buffer liquid has an acoustic impedance $Z_{BL}$ of approximately $1.75*10^8$ g/(m$^2$.s). If polyethylene (having an acoustic impedance $Z_{IB}$ of approximately $1.75*10^8$ g/(m$^2$.s)) is used as a material for the intermediate body 28, the acoustic wave will pass undisturbed through the interface of the buffer liquid 34 and the intermediate body 28. Some loss of acoustic energy due to reflection will occur only on the interface of the intermediate body 28 and the ink 17. The reflection coefficient is determined by $$R = \frac{Z_{IB} - Z_{INK}}{Z_{IB} + Z_{INK}},$$

and, for the above combination, will be less than 0.08. (David R. Lide, *CRC Handbook of Chemistry and Physics*, p. 14–35).

Figure 7:
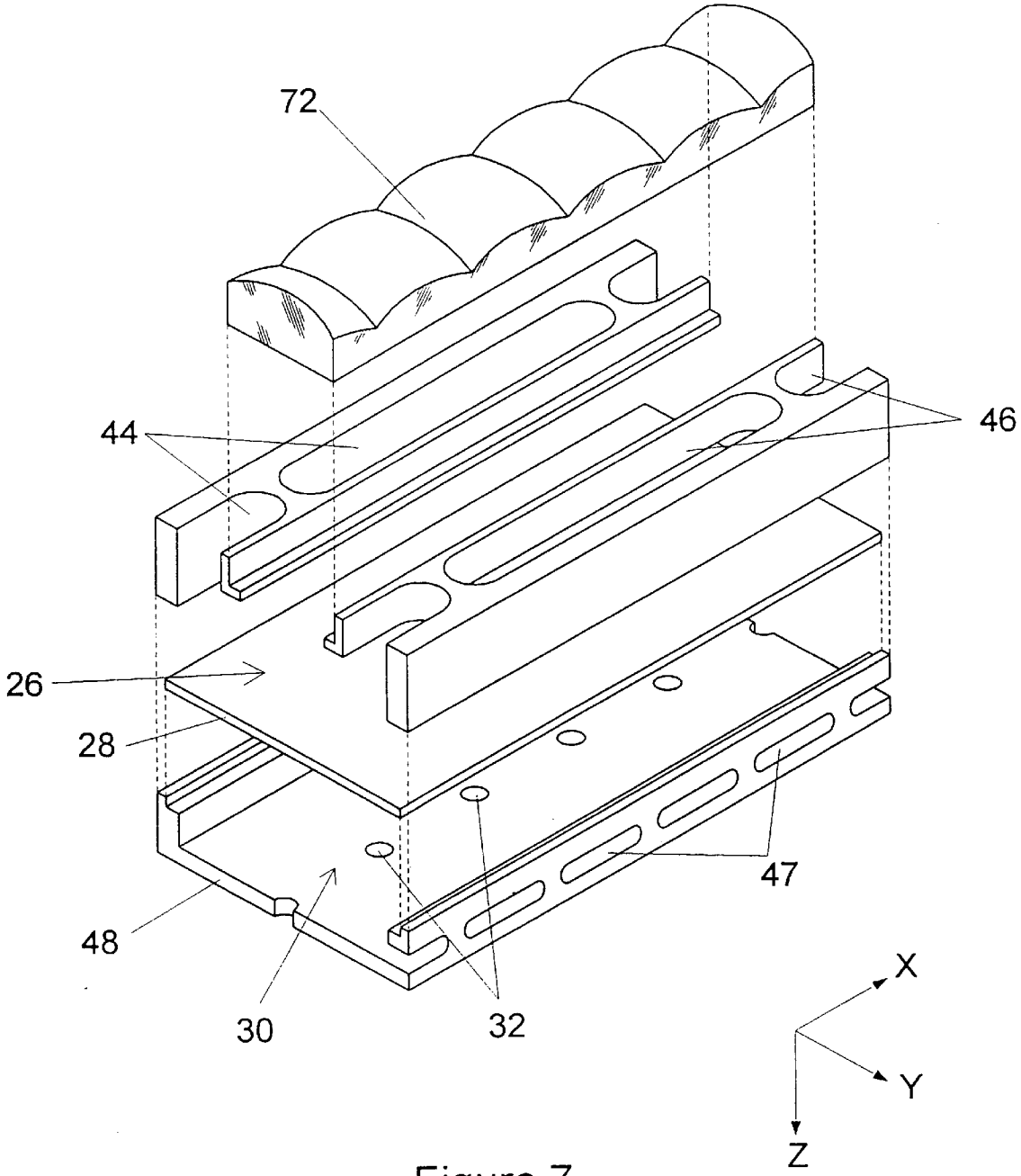
FIG. 7 is an exploded isometric view of an alternative linear array.

Reference is now made to FIG. 7, which is an exploded isometric view of an alternative linear array. FIG. 7 presents the same view as FIG. 4, with a micro-lens array 72 instead of a flat optical window 24, as in FIG. 4. In many cases the micro-lens can increase the numerical aperture of the illuminating optical system, and thus smaller concentration spots and better collection of the laser light can be achieved.

Figure 8:
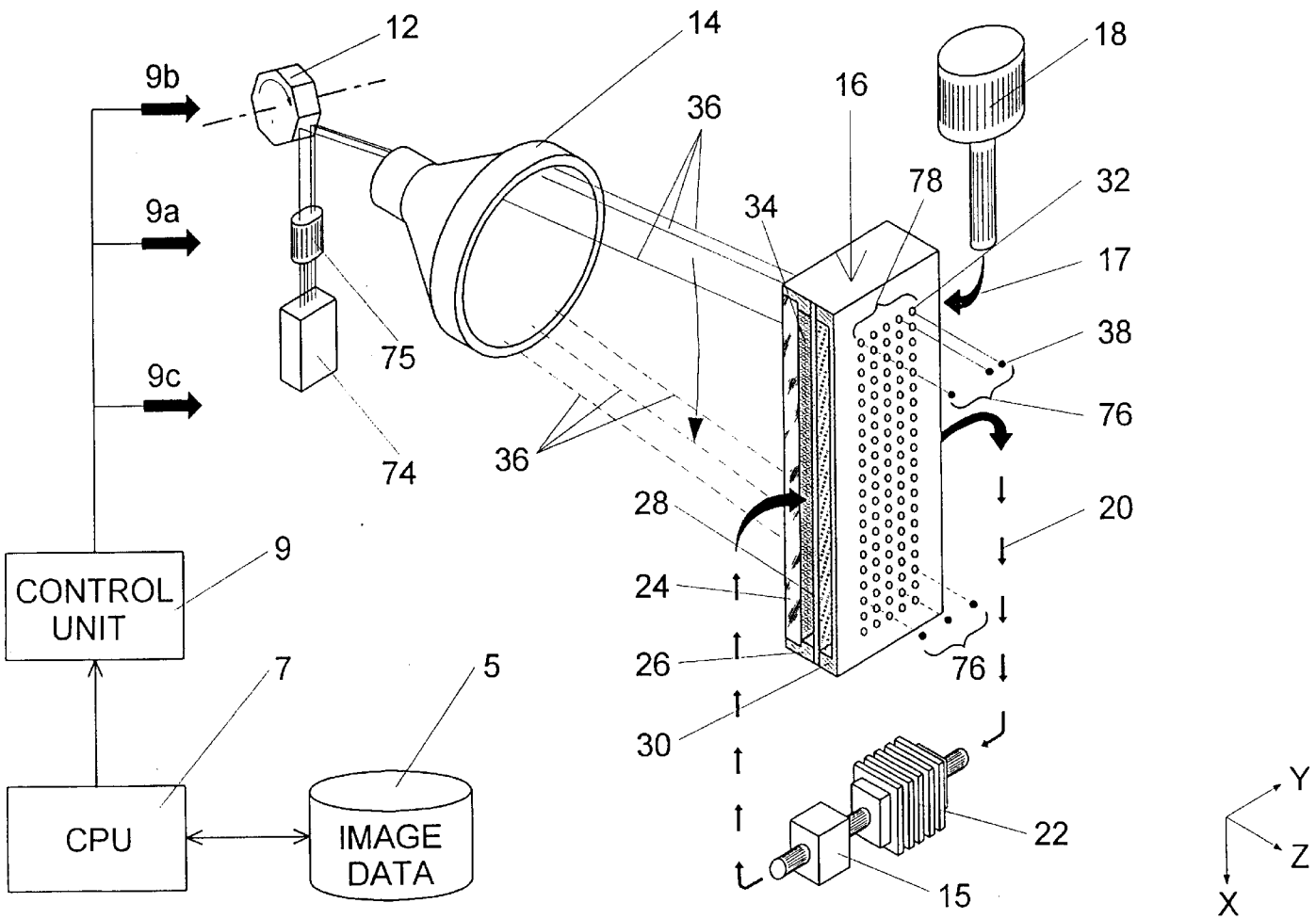
FIG. 8 is a schematic illustration of a print engine based on a two-dimensional array print head.

Reference is now made to FIG. 8, which is a schematic illustration of a print engine based on a two-dimensional array print head. FIG. 8 presents the same illustration as FIG. 2B, with a multi-beam laser source 74 instead of the single-beam laser source 10, a multi-beam modulator 75 instead of the single-beam modulator 13, and an ink chamber 30 with a two-dimensional array of nozzle orifices 32 instead of a linear array, as in FIG. 2B.

As the laser beams 36 scan the print head 16 in the scanning direction X, a row 76 of droplets 38 of ink is ejected from each row 78 of ink orifices 32 in turn. The scanning system 12 operates continuously, but the individual beams of the multi-beam laser source 74 are turned on and off by the modulator 75, controlled by the control unit 9, in accordance with the image data 5 to be printed, thereby determining from which orifices 32 an ink droplet will be ejected. This operation produces the desired image formed by droplets 38 on the substrate 11 (not shown). The multi-beam laser source 74 could be a bar laser diode of the SLD series produced by Sony Semiconductor of Tokyo, Japan. An example of the multi-beam light modulator 75 is the GLV Linear Array modulator produced by Silicon Light Machines of Sunnyvale, Calif., USA.

Figure 9A:
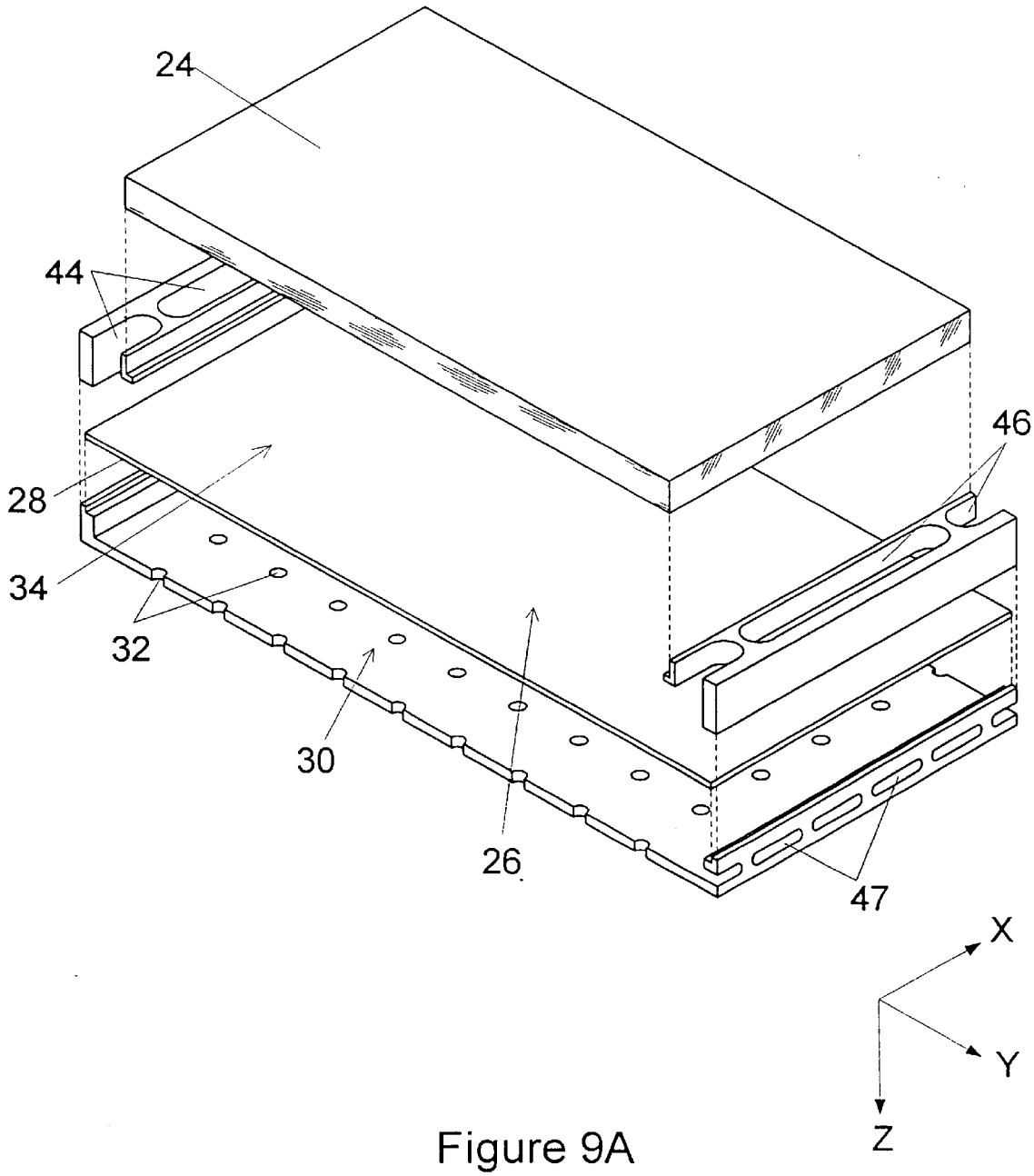
FIGS. 9A and 9B are exploded isometric views of two alternative two-dimensional arrays.
Figure 9B:
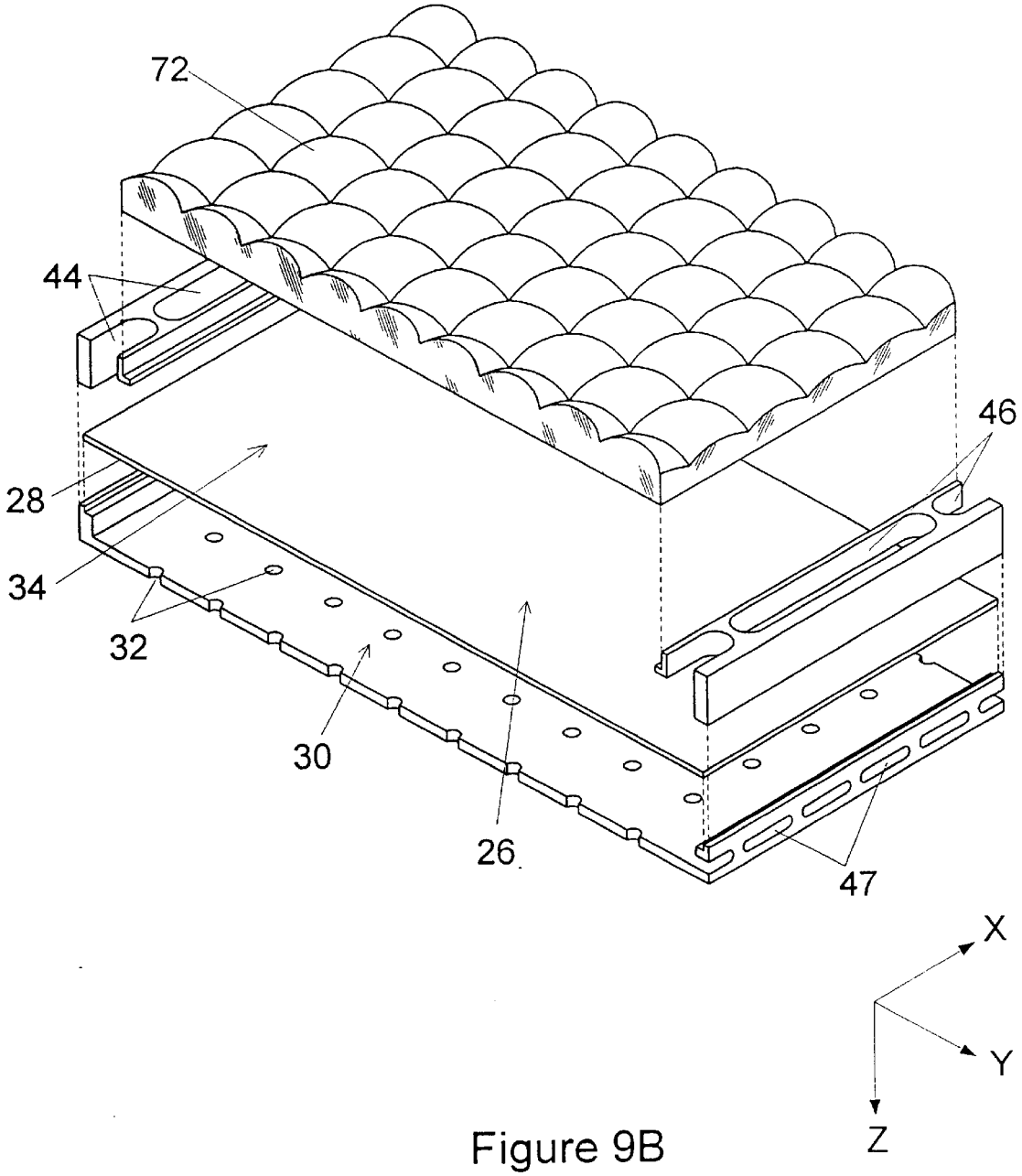

Reference is now made to FIGS. 9A and 9B, which present an isometric view of the two-dimensional array print head of FIG. 8. FIG. 9A presents the same view as FIG. 4, with a two-dimensional array of orifices 32 instead of a linear array, as in FIG. 4. FIG. 9B presents the same view as FIG. 7, with a two-dimensional array of orifices 32 instead of a linear array, as in FIG. 7.

It will be appreciated by persons skilled in the art that the present invention is not limited by what has been particularly shown and described herein above. Rather the scope of the invention is defined by the claims that follow:

What is claimed is:

1. A print head comprising:

a single buffer chamber to store a buffer liquid therein within which acoustic waves are generated;

a body forming one wall of said buffer chamber; and a single ink chamber, sharing said body as a wall, to store ink therein and having a plurality of orifices on a wall opposite to said body.

2. A print head according to claim 1, wherein said plurality of orifices is arranged in a linear array.

3. A print head according to claim 1, wherein said plurality of orifices is arranged in a two-dimensional array.

4. The print head of claim 1, wherein said body is made of a material having acoustic impedance that is substantially similar to that of said buffer liquid and said ink.

5. A print head comprising:

a single ink chamber for storing ink therein and having a plurality of orifices, wherein a droplet of said ink exits through a selected one of said orifices in the presence of a directional acoustic wave in the vicinity of said selected orifice;

a single buffer chamber for storing a buffer liquid therein within which said acoustic wave is generated; and a body between said ink chamber and said buffer chamber for providing acoustic coupling between said ink and said buffer liquid.

6. A print head according to claim 5, wherein said plurality of orifices is arranged in a linear array.

7. A print head according to claim 5, wherein said plurality of orifices is arranged in a two-dimensional array.

8. A print head according to claim 5, wherein said body is formed of a material which minimizes attenuation of said acoustic wave.

9. A print head according to claim 5, wherein said acoustic wave is generated by absorption of laser light in said buffer liquid.

10. A print head according to claim 9, wherein a wall of said buffer chamber opposite to said body is an optical element substantially transparent for said laser light.

11. A print head according to claim 10, wherein said optical element is a flat optical window.

12. A print head according to claim 10, wherein said optical element is a microlens array which improves focussing of said laser light into said buffer liquid.

13. The print head according to claim 9, wherein said buffer liquid is characterized by high absorption for said laser light.

14. The print head according to claim 5, wherein said acoustic wave is delivered to said selected orifice without using an acoustic lens.

15. A printing device comprising:

a laser for generating at least one laser beam;

a controller to modulate said at least one laser beam according to image data to be printed;

a print head having a plurality of orifices and comprising a single buffer chamber to store a buffer liquid therein; and an ink supply for supplying ink to said print head, wherein said at least one modulated laser beam selectively generates a directional acoustic wave within said buffer chamber, thereby inducing an ink droplet to exit a selected one of said orifices onto a printing substrate.

16. A printing device according to claim 15, wherein said printing device is a printing press.

17. A printing device according to claim 15, wherein said printing device is an ink-jet printer.

18. A printing device according to claim 15, wherein said laser is a laser diode.

19. A printing device according to claim 15, wherein said plurality of orifices is arranged in a linear array.

20. A printing device according to claim 15, wherein said plurality of orifices is arranged in a two-dimensional array.

21. A printing device according to claim 15, wherein said printing device additionally comprises a scanner for moving said modulated laser beam in a scanning direction such that said modulated laser beam is focussed in the vicinity of said selected orifice.

22. A printing device according to claim 21, wherein said print head further comprises:

a body forming one wall of said buffer chamber; and a single ink chamber, sharing said body as a wall, for storing said ink therein and having said plurality of orifices on a wall opposite to said body.

23. A printing device according to claim 22, wherein said buffer liquid flows in a direction perpendicular to said scanning direction.

24. A printing device according to claim 21, wherein said print head further comprises:

a single ink chamber for storing said ink therein, wherein said droplet exits through said selected orifice in the presence of said acoustic wave in the vicinity of said selected orifice; and a body between said ink chamber and said buffer chamber for providing acoustic coupling between said ink and said buffer liquid.

25. A printing device according to claim 15, wherein said print head further comprises:

a body forming one wall of said buffer chamber; and a single ink chamber, sharing said body as a wall, for storing said ink therein and having said plurality of orifices on a wall opposite to said body.

26. A printing device according to claim 25, wherein said buffer liquid is cooled.

27. A printing device according to claim 25, wherein said body is formed of a material which minimizes attenuation of said acoustic wave.

28. A printing device according to claim 25, wherein said acoustic wave is generated by absorption of said modulated laser beam in said buffer liquid.

29. A printing device according to claim 25, wherein a wall of said buffer chamber opposite to said body is an optical element substantially transparent for said modulated laser beam.

30. A printing device according to claim 29, wherein said optical element is a flat optical window.

31. A printing device according to claim 29, wherein said optical element is a microlens array which improves focussing of said modulated laser beam into said buffer liquid.

32. A printing device according to claim 15, wherein said print head further comprises:

a single ink chamber for storing said ink therein, wherein said droplet exits through said selected orifice in the presence of said acoustic wave in the vicinity of said selected orifice; and a body between said ink chamber and said buffer chamber for providing acoustic coupling between said ink and said buffer liquid.

* * * * *